United States Patent [19]

Davison

[11] 4,395,834

[45] Aug. 2, 1983

[54] METHOD AND APPARATUS FOR EXCAVATING TRENCHES

[76] Inventor: Geoffrey W. Davison, 157 High St., Cottenham, Cambridge, England

[21] Appl. No.: 320,103

[22] Filed: Nov. 10, 1981

Related U.S. Application Data

[63] Continuation of Ser. No. 64,499, Aug. 7, 1979, abandoned.

[30] Foreign Application Priority Data

Aug. 8, 1978 [GB] United Kingdom ..... 32558/78

[51] Int. Cl.[3] ..... E02F 5/02

[52] U.S. Cl. ..... 37/98

[58] Field of Search ..... 37/98, 100, 80 A, DIG. 16, 37/DIG. 17, DIG. 18, 195, 2 R; 172/694, 547, 558, 559, 560

[56] References Cited

U.S. PATENT DOCUMENTS

| | | | |
|---|---|---|---|
| 74,653 | 2/1868 | Williams | 37/100 |
| 123,286 | 1/1872 | Nevill | 37/100 |
| 280,112 | 6/1883 | Allaben | 37/98 X |
| 716,378 | 12/1902 | Chapman | 37/98 |
| 2,507,364 | 3/1950 | Traver | 172/547 |
| 2,748,506 | 6/1956 | Stosberg, Jr. | 37/98 |
| 3,527,501 | 9/1970 | Shatto, Jr. | 37/DIG. 18 |
| 3,815,266 | 6/1974 | Schmitz et al. | 37/2 R |
| 3,863,721 | 2/1975 | Scerbo et al. | 37/DIG. 18 |

FOREIGN PATENT DOCUMENTS

| | | | |
|---|---|---|---|
| 276086 | 2/1912 | Fed. Rep. of Germany | 172/547 |
| 7187 | 4/1922 | Netherlands | 37/98 |
| 231908 | 4/1925 | United Kingdom | 37/98 |
| 642060 | 8/1950 | United Kingdom | 37/98 |
| 675959 | 7/1952 | United Kingdom | 37/98 |
| 484839 | 11/1975 | U.S.S.R. | 37/2 R |

*Primary Examiner*—E. H. Eickholt

*Attorney, Agent, or Firm*—Watson, Cole, Grindle & Watson

[57] ABSTRACT

An apparatus for excavating a trench comprises two blades which are spaced apart laterally and arranged to form two slits in the ground, and two laterally spaced excavating discs arranged one behind each blade to run substantially in the cut of the preceding blade and operable to grip spoil between the cuts and remove the spoil to form the trench.

4 Claims, 5 Drawing Figures

METHOD AND APPARATUS FOR EXCAVATING TRENCHES

This application is a continuation application of application Ser. No. 64,499, filed Aug. 7, 1979, now abandoned.

This invention relates to a method and apparatus for excavating trenches in the ground.

Previously proposed apparatus for such excavation have a moving toothed chain or rotating toothed wheel, the width of which is the same as the width of the trench to be formed. The teeth of the chain or wheel dig into the ground as the apparatus is moved along the ground and both cut the earth and remove the spoil to form the trench.

In accordance with one aspect of the present invention, there is provided an apparatus for excavating a trench in the ground, comprising two blades which are laterally spaced apart and which are arranged to form two slits in the ground, and two laterally spaced apart excavating elements arranged one behind each blade to run substantially in the cut of the associated blade and operable to grip spoil between the cuts and remove the spoil to form the trench.

Preferably, the blades are staggered in the direction of travel, thereby avoiding the possibility of spoil or stones being trapped between them. The blades are preferably reciprocable in the direction of movement of the apparatus.

The lateral distance between the blades is preferably adjustable to vary the width of the trench to be excavated.

Preferably, the excavating elements each comprise a rotatable disc, the discs being resiliently biased towards each other to grip the spoil therebetween. A spoil-removing device may be provided to remove the spoil from between the elements and deposit the spoil in a suitable receptacle, for example a conveyor or elevator.

A spoil guide is preferably located immediately behind the elements to run in the trench and ensure that substantially all spoil between the cuts is removed by the discs.

The apparatus may include, or have attached thereto, a suitable apparatus for pipe laying and/or backfilling the trench with suitable material such as sand or gravel.

In accordance with another aspect of the invention, there is provided a method of excavating a trench in ground, comprising the steps of cutting laterally spaced slits in the ground, and gripping the spoil between the slits between excavating elements running substantially in the slits, the elements removing the spoil from between the slits.

Figure 1:
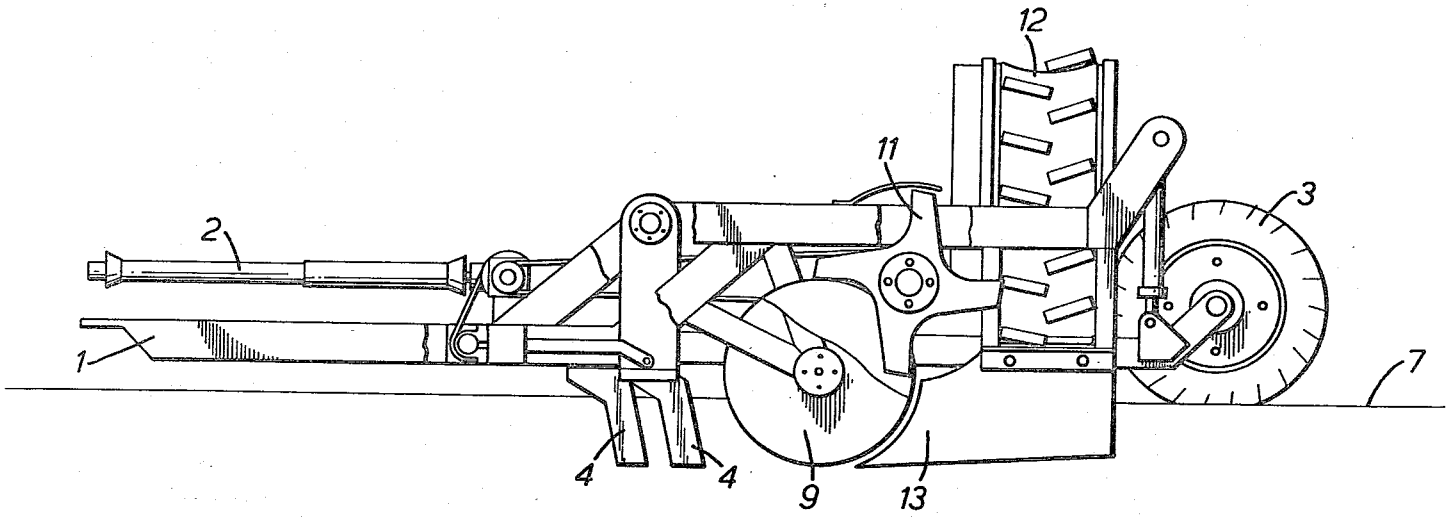
Figure 2:
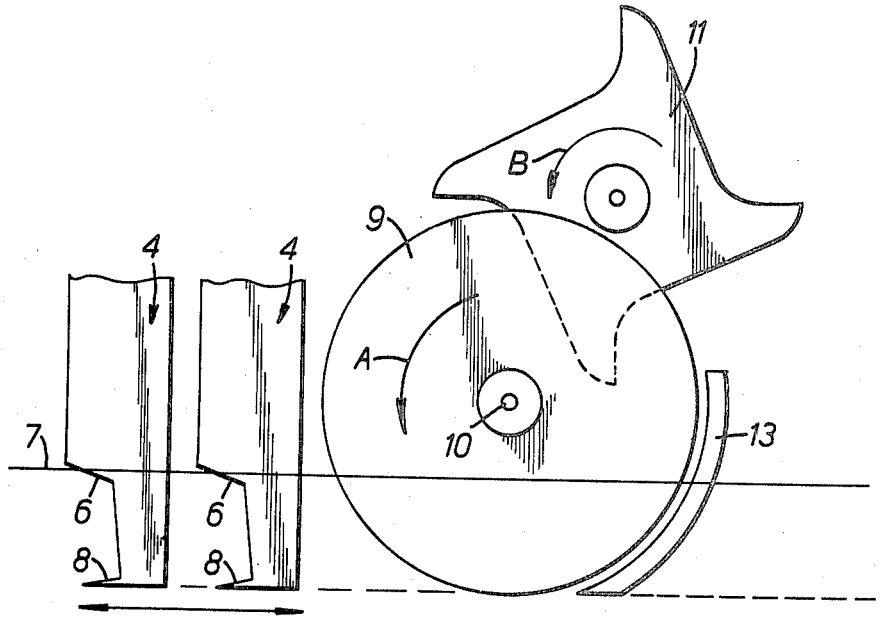
Figure 3:
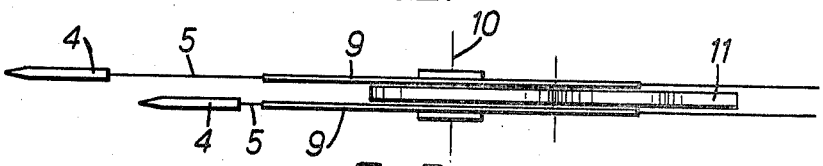
Figure 4:
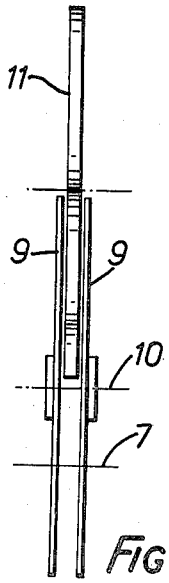
Figure 5:
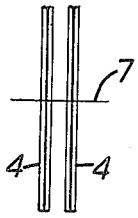

A method and apparatus in accordance with the invention for excavating a trench will now be described, by way of example, with reference to the accompanying drawings, in which:

FIG. 1 is a diagrammatic side view of the apparatus with parts cut away for clarity, FIG. 2 is a diagrammatic side view of part of the apparatus, FIG. 3 is a diagrammatic plan view from above of the part of the apparatus of FIG. 2, FIG. 4 is a diagrammatic rear view of the apparatus of FIG. 2, and FIG. 5 is a detail front view of blades of the apparatus.

The apparatus is arranged to be towed by a tractor (not shown) and comprises a tow bar 1 and a drive shaft 2 for connection to the tractor. The rear of the apparatus is supported by wheels 3.

Two laterally spaced apart blades 4 are arranged to oscillate in a forward/backward direction in the ground to form two slits. The lateral distance x (FIG. 5) between the blades 4 is adjustable by any suitable means (not shown) to thereby adjust the distance between the slits 5 formed by the blades and thus the width of the trench. Preferably, the blades 4 can be adjusted to a minimum distance apart of about 25 mm.

The blades are preferably vertically disposed to cut parallel, vertical slits in the ground, but they may be disposed at an angle to the vertical if a trench of trapezoidal cross-section is desired. The device for oscillating the blades may take any suitable form and is driven from the rotary drive shaft 2. Furthermore, the oscillating movement may be at a speed which enables the forward cutting action of the blades to be greater than the speed of the apparatus as a whole.

As more clearly illustrated in FIG. 2, the blades 4 are staggered, i.e., spaced apart longitudinally of the apparatus, to avoid the possibility of spoil or stones from becoming jammed between them.

The shape of each blade 4 is preferably as illustrated in FIG. 2, each blade having an inclined portion 6 in the region of the ground level 7 to facilitate a neat cut and ensure that little surface disturbance of the ground adjacent the blade is caused when a suitable cutting speed is chosen. Furthermore, each blade has a laterally inwardly extending inclined shoe 8 at its lower end for the purpose of assisting the apparatus to remain at its correct depth when in use and/or for the purpose of horizontally cutting the base of the trench to thereby assist in removal of spoil from the trench.

Located behind the blades 4 are two circular excavating elements in the form of discs 9 which are rotatable about an axle 10. The discs may be freely rotatable in the direction of arrow A at a speed determined by the forward motion of the apparatus, or their rotation may be power assisted, by means of a connection to drive shaft 2. The discs 9 are arranged directly behind the respective blades 4 and run in the slits 5 formed by the blades. In the region of the axle 10 of the discs a spring biasing arrangement (not shown) urges the discs towards each other causing them to grip the spoil in the space between them. The gripped spoil is, by virtue of the rotation of the discs 9, continuously carried out of the trench to above ground level. At a location above ground level the spoil between the disc is removed by a power-rotated, spoil-removing device 11 in the form of a scoop assembly rotating in the direction of arrow B. The device 11 removes the spoil to a suitable elevator or conveyor 12 from which the spoil may be transferred to a suitable container. However, the spoil may be deposited from the device 11 directly on to the surface of the ground.

A curved guide plate 13 is arranged immediately behind the discs 5 and spans the width of the trench, the plate ensuring that substantially all the spoil is gripped between the discs and is removed, thereby leaving a completely excavated trench.

It will be appreciated that many modifications of the above-described apparatus are possible. For example, the blades 4 may take any suitable form and need not oscillate.

A suitable pipe laying and/or back filling apparatus, such as described in the Provisional Specification of my co-pending British Patent Application No. 25822/78 may be attached to or form part of the above-described apparatus.

The above-described apparatus excavates trenches faster than apparatuses having toothed chain or wheels and has a variable cutting width to enable trenches of different widths to be excavated using the same apparatus.

I claim:

1. An apparatus for excavating a trench in the ground which comprises an elongated frame means having a forward end and a rearward end; at least one support wheel connected to said frame means for allowing said frame means to be moved along the ground to be excavated; two laterally spaced apart blades mounted to extend downwardly from said frame means to form two parallel slits in the ground, said blades also being spaced apart longitudinally of said frame means; two aligned, rotatable solid discs mounted on said frame means, each said disc being arranged to run directly behind a respective blade and sized such that its peripheral edge will extend below said frame means a distance equal to the distance its associated blade extends below said frame means, said discs rotating with forward movement of said frame means and acting together to grip and upwardly lift the spoiled ground between the two slits formed by said two blades and thereby form a trench; and a discharge means mounted on said frame means which includes a portion which extends between said discs to remove the spoiled ground which has been uplifted thereby.

2. The excavating apparatus as defined in claim 1 wherein said discharge means includes a horizontally oriented central axle which is rotatably mounted on said frame means rearwardly of said discs, and wherein said portion of said discharge means which extends between said discs includes multiple arm portions which extend radially outwardly from said central axle into the space between said discs, said discharge means rotating oppositely to said discs to remove spoiled ground from therebetween.

3. The excavating apparatus as defined in claim 1 wherein each support wheel is connected to said frame means near its rearward end; and wherein each blade includes an inclined shoe portion which extends towards the forward end of said frame means.

4. The excavating apparatus as defined in claim 3 wherein each blade includes a forward facing edge, a rearward facing edge and a lowermost bottom edge; wherein each blade includes a cut-away section on its forward facing edge near its lowermost bottom edge; and wherein each cut-away section is shaped to form an inclined shoe portion of the blade adjacent its lowermost bottom edge.

* * * * *